US011098631B2

(12) United States Patent
Denis et al.

(10) Patent No.: US 11,098,631 B2
(45) Date of Patent: Aug. 24, 2021

(54) NOX SENSOR PROTECTION SYSTEM

(71) Applicant: Caterpillar Inc., Deerfield, IL (US)

(72) Inventors: Andrew M. Denis, Normal, IL (US); Min Xiao, Jiangsu (CN); Wengang Chen, Jiangsu (CN); Zhenhua Zhang, Jiangsu (CN); Qiang Zhu, Jiangsu (CN); Mohamed I. Daoud, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 19 days.

(21) Appl. No.: 16/523,628

(22) Filed: Jul. 26, 2019

(65) Prior Publication Data

US 2021/0025314 A1 Jan. 28, 2021

(51) Int. Cl.

| | |
|---|---|
| ***F01N 13/08*** | (2010.01) |
| ***F01N 13/00*** | (2010.01) |
| ***F01N 11/00*** | (2006.01) |

(52) U.S. Cl.

CPC ..... *F01N 13/008* (2013.01); *F01N 11/00* (2013.01); *F01N 13/08* (2013.01); *F01N 2560/026* (2013.01); *F01N 2560/20* (2013.01)

(58) Field of Classification Search

CPC ..... F01N 13/008; F01N 13/08; F01N 11/00; F01N 2560/026; F01N 2560/20; F02D 19/0657; F02D 19/06

See application file for complete search history.

(56) References Cited

U.S. PATENT DOCUMENTS

| | | | | |
|---|---|---|---|---|
| 4,911,201 | A | 3/1990 | Nichols et al. | |
| 5,603,216 | A * | 2/1997 | Guile | F01N 3/0835 60/288 |
| 6,581,377 | B2 | 6/2003 | Carlson et al. | |
| 6,843,104 | B2 * | 1/2005 | Busch | G01N 1/2252 73/23.31 |
| 7,096,583 | B2 | 8/2006 | Steed | |
| 7,610,142 | B1 * | 10/2009 | Hoard | F01N 13/008 60/274 |
| 7,942,710 | B2 | 5/2011 | Gaither | |
| 8,696,777 | B1 * | 4/2014 | Patil | F01N 13/10 55/385.3 |
| 8,756,913 | B2 * | 6/2014 | Liu | F01N 3/2066 60/276 |
| 9,140,625 | B2 | 9/2015 | Doering | |
| 9,804,137 | B2 | 10/2017 | Doering | |

(Continued)

FOREIGN PATENT DOCUMENTS

| | | | |
|---|---|---|---|
| CN | 104439898 | A | 3/2015 |
| DE | 102005015479 | A1 | 10/2006 |

(Continued)

*Primary Examiner* — Matthew T Largi

(74) *Attorney, Agent, or Firm* — Leydig, Volt & Mayer, Ltd.

(57) ABSTRACT

A NOx sensor protection system includes a flow control device forming an internal chamber with exhaust and shield gas ports and a NOx sensor. The flow control device is configured to selectively allow a flow of exhaust from an exhaust pipe to the NOx sensor when an internal combustion engine is operated with a first fuel, and to selectively direct shield gas from the shield gas port at an angle of 135° to 180° to the NOx sensor to inhibit the flow of exhaust from the exhaust pipe to the NOx sensor when the engine is operated with a second fuel.

20 Claims, 4 Drawing Sheets

(56) References Cited

U.S. PATENT DOCUMENTS

| | | | | |
|---|---|---|---|---|
| 2005/0262833 | A1* | 12/2005 | Andrews | F02D 41/1439 60/288 |
| 2007/0214862 | A1* | 9/2007 | Kubinski | F01N 13/18 73/1.06 |
| 2008/0000667 | A1* | 1/2008 | Ruterbusch | G01N 27/4077 174/16.1 |
| 2010/0243446 | A1* | 9/2010 | Mizutani | G01N 27/417 204/427 |
| 2012/0330539 | A1 | 12/2012 | Weber | |
| 2013/0115152 | A1 | 5/2013 | Nordberg et al. | |
| 2014/0130589 | A1* | 5/2014 | Doering | F02D 41/1463 73/114.73 |
| 2014/0208724 | A1* | 7/2014 | Denis | F01N 13/008 60/301 |
| 2015/0075269 | A1* | 3/2015 | Van Mullem | G01N 33/0006 73/114.71 |
| 2017/0175655 | A1 | 6/2017 | RempelEwert et al. | |
| 2018/0149065 | A1 | 5/2018 | Kawakami et al. | |

FOREIGN PATENT DOCUMENTS

| | | | | |
|---|---|---|---|---|
| EP | 1561982 | B1 | 5/2007 | |
| EP | 2332826 | A1 * | 6/2011 | B01F 15/066 |
| EP | 2981346 | | 2/2016 | |
| EP | 3431731 | | 1/2019 | |
| EP | 3731731 | A | 1/2019 | |

* cited by examiner

NOX SENSOR PROTECTION SYSTEM

TECHNICAL FIELD

The present disclosure generally relates to internal combustion engines configured to be operated with two types of fuel, in particular, to the protection of a NOx sensor provided in an exhaust system of such an internal combustion engine.

BACKGROUND

Internal combustion engines exhaust a complex mixture of air pollutants. These air pollutants are composed of gaseous compounds such as nitrogen oxides (NOx), and solid particulate matter also known as soot. Due to increased environmental awareness, exhaust emission standards have become more stringent, and the amount of NOx and soot emitted to the atmosphere by an engine may be regulated depending on the type of engine, size of engine, and/or class of engine.

In order to ensure compliance with the regulation of NOx, a strategy called selective catalytic reduction (SCR) for treating the exhaust gas can be implemented. SCR is a process where a gaseous or liquid reductant, e.g. ammonia, urea or an urea solution, is injected into the exhaust gas stream of an engine. The reductant reacts with nitrogen oxides in the exhaust gas to form water and nitrogen. Usually, urea is introduced into the exhaust gases in an amount sufficient to provide the degree of NOx reduction desired. The desired amount of the reductant can be controlled by, e.g., an urea injection system, for example, based on a detection by a NOx sensor.

In marine vessels, specifically large ships such as ferries, cruise ships or cargo ships, one or more internal combustion engines of the ship may be configured to operate with heavy fuel oil (HFO) and marine diesel oil (MDO). Due to environmental regulations, it may be necessary to change over between operating fuels. For example, while the ship may run on HFO at sea, it may be necessary to switch to running on MDO near harbors or the like, in order to meet emission standards such as IMO III.

Components in the emissions when operating with HFO, however, may interfere with the operation of a NOx sensor when the ship switches over to run on MDO. For example, a high sulfur content in HFO exhaust gas may damage or inhibit proper operation a NOx sensor. Arrangements such as the ones disclosed in European Patent Application EP 3 431 731 A1, which is assigned to Caterpillar Motoren GmbH & Co., discloses various arrangements with the goal of eliminating or minimizing damage to the operation of the NOx sensor as a result of HFO exhaust gas.

The present disclosure is directed, at least in part, to improving or overcoming one or more aspects of prior systems.

SUMMARY

According to an aspect of the present disclosure, there is provided a NOx sensor protection system for an internal combustion engine configured to be selectively operated with a first fuel and a second fuel, and having an exhaust pipe configured to receive exhaust resulting from combustion of the first fuel or the second fuel in the internal combustion engine. The NOx sensor protection system includes a flow control device forming an internal chamber and a plurality of ports opening into the internal chamber. The plurality of ports includes an exhaust port configured to fluidly communicate with the exhaust pipe to receive exhaust flowing in the exhaust pipe, and a shield gas port configured to selectively receive a shield gas from an external source of shield gas. A NOx sensor is disposed within the internal chamber to measure a NOx concentration in the exhaust received within the internal chamber. The flow control device is configured to selectively allow a flow of exhaust from the exhaust pipe to the NOx sensor when the internal combustion engine is operated with the first fuel, and a flow of the shield gas into the internal chamber to inhibit the flow of exhaust from the exhaust pipe to the NOx sensor when the internal combustion engine is operated with the second fuel. The shield gas port and the NOx sensor are configured to direct the flow of shield gas from the shield gas port at an angle on the order of 135° to 180° to the NOx sensor.

According to another aspect of the present disclosure, there is provided a NOx sensor protection system for an internal combustion engine configured to be selectively operated with a first fuel and a second fuel, and an exhaust pipe configured to receive exhaust resulting from combustion of the first fuel or the second fuel in the internal combustion engine. The NOx sensor protection system includes a flow control device forming an internal chamber and a plurality of ports opening into the internal chamber. The plurality of ports includes an exhaust port configured fluidly communicate with the exhaust pipe to receive exhaust flowing in the exhaust pipe and direct the exhaust gas into the internal chamber, and a shield gas port configured to be selectively fluidly coupled to an external source of a shield gas and direct the shield gas into the internal chamber. A NOx sensor is disposed within the internal chamber to measure a NOx concentration in the exhaust received within the internal chamber. The flow control device is configured to selectively allow a flow of exhaust from the exhaust pipe to the NOx sensor when the internal combustion engine is operated with the first fuel, and a flow of the shield gas into the internal chamber to inhibit the flow of exhaust from the exhaust pipe to the NOx sensor when the internal combustion engine is operated with the second fuel. The shield gas port and the NOx sensor are configured to provide the flow of the shield gas from the shield gas port directly at the NOx sensor, the shield gas port being disposed within 2-5 mm of the NOx sensor.

According to yet another aspect of the present disclosure, there is provided a NOx sensor protection system for an internal combustion engine configured to be selectively operated with a first fuel and a second fuel, and an exhaust pipe configured to receive exhaust resulting from combustion of the first fuel or the second fuel in the internal combustion engine. The NOx sensor protection system includes a NOx sensor, a collection duct disposed within the flow of exhaust flowing in the exhaust pipe, a nozzle configured to selectively receive a shield gas from an external source of shield gas, and a flow control device including a manifold forming an internal chamber. The manifold has a plurality of bores opening into the internal chamber, the plurality of bores including a NOx sensor bore, an exhaust bore, a shield gas bore, and an exit opening. The collection duct is fluidly coupled to the exhaust bore to form an exhaust port, fluidly coupling exhaust flowing in the exhaust pipe to the exhaust port to provide a flow of exhaust into and through the internal chamber to the exit opening. The NOx sensor extends through the NOx sensor bore and disposed within the internal chamber to measure a NOx concentration in exhaust received within the internal chamber. The nozzle extends through the shield gas bore and forms a shield gas port. The flow control device is configured to selectively allow the flow of exhaust from the exhaust pipe to the NOx sensor when the internal combustion engine is operated with the first fuel, and a flow of the shield gas through the shield gas port into the internal chamber to inhibit the flow of exhaust from the exhaust pipe to the NOx sensor when the internal combustion engine is operated with the second fuel.

Other features and aspects of this disclosure will be apparent from the following description and the accompanying drawings.

BRIEF DESCRIPTION OF THE DRAWING(S)

DETAILED DESCRIPTION

Figure 1:
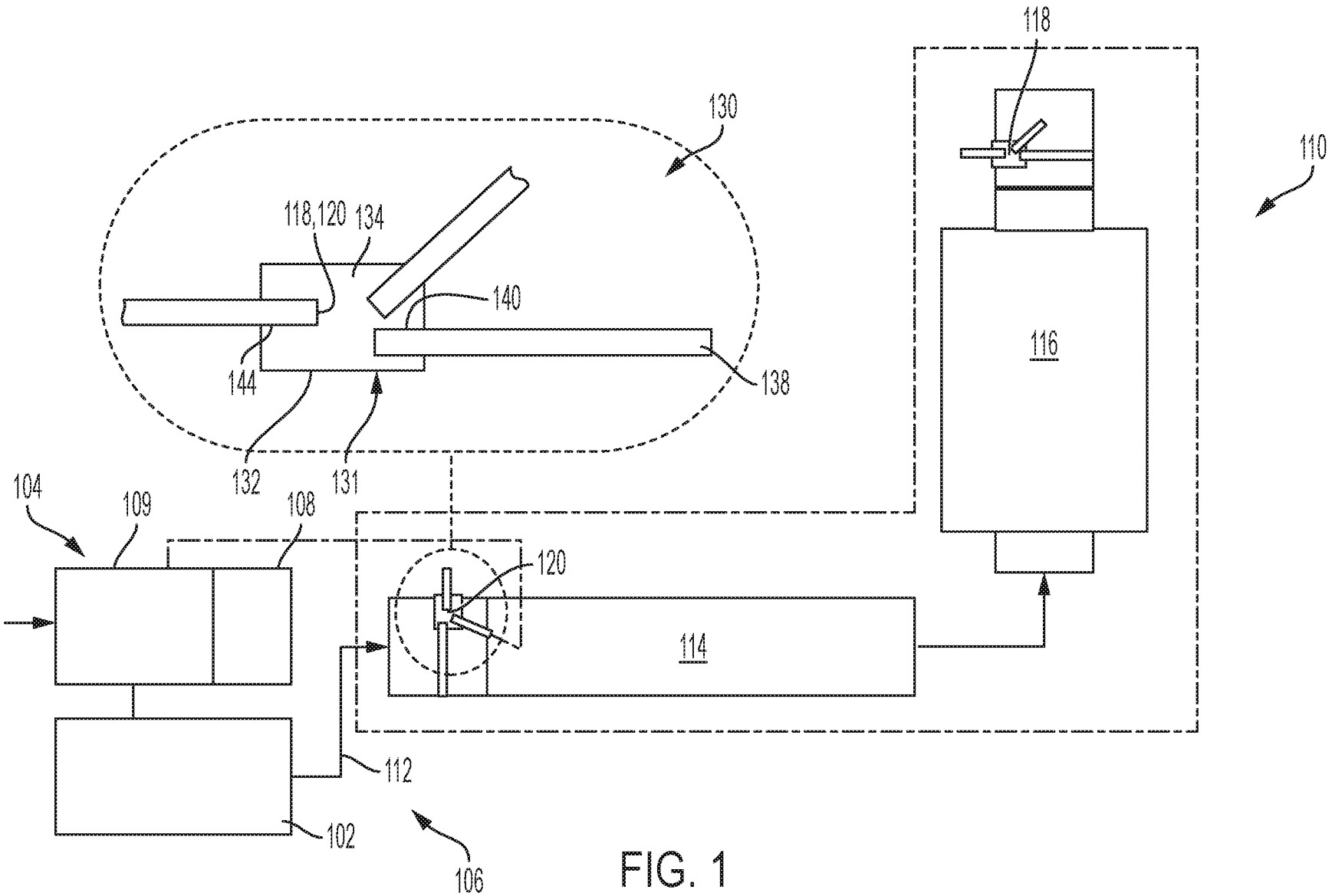
FIG. 1 shows a schematic overview of an internal combustion engine system including a NOx sensor protection system in accordance with aspects of the present disclosure, the schematic further including an enlarges schematic view of the NOx sensor protection system.

The following is a detailed description of exemplary embodiments of the present disclosure. The exemplary embodiments described therein and illustrated in the drawings are intended to teach the principles of the present disclosure, enabling those of ordinary skill in the art to implement and use the present disclosure in many different environments and for many different applications. Therefore, the exemplary embodiments are not intended to be, and should not be considered as, a limiting description of the scope of patent protection. Rather, the scope of patent protection shall be defined by the appended claims.

This disclosure relates to internal combustion engines configured to be operated with two types of fuel, and more specifically to an exhaust treatment arrangement and an NOx sensor protection system. An exemplary internal combustion engine system 100 shown in FIG. 1 includes an internal combustion engine 102 configured to be selectively operated with a first fuel such as marine diesel oil (MDO) and a second fuel producing exhaust gas having, for example, a high sulfur content such as heavy fuel oil (HFO). As used herein, the term "first fuel" generally refers to a first type of fuel, for example, MDO or gaseous fuel, and the term "second fuel" generally refers to a second type of fuel that is different from the first type, for example, HFO. Those of skill in the art will appreciate that intake air is supplied to internal combustion engine 102 via an air intake system 104, and the mixture of intake air and liquid fuel is combusted in combustion chambers of internal combustion engine 102 to produce a mechanical output. Exhaust gas resulting from the combustion of the first fuel or the second fuel is discharged from the internal combustion engine 102 via an exhaust system 106.

A turbocharger 108 may be provided to compress intake air supplied to internal combustion engine 102 via a compressor 109 associated with the air intake system 104. Further, a SCR aftertreatment module or system 110 is provided in an exhaust pipe 112 connected to internal combustion engine 102. The configuration of SCR system 110 may be of any appropriate configuration known, or developed in the future, and may include, for example, an SCR mixer 114 and an SCR reactor 116.

In accordance with an aspect of this disclosure, one or more NOx sensors are provided. In the illustrated embodiment of FIG. 1, a first NOx sensor 118 is fluidly communicated with exhaust pipe 112 and configured to measure a NOx concentration in the exhaust flowing through exhaust pipe 112 downstream the SCR system 110. A second NOx sensor 120 is disposed upstream of SCR system 110 and is also configured to measure the NOx concentration in the exhaust gas flowing through exhaust pipe 112 upstream the SCR system 110. Each of NOx sensors 118 and 120 is connected to an evaluation unit 122 via a sensor line 124 (as shown schematically, for example, in FIG. 2). Evaluation unit 122 is configured to evaluate the detection results from NOx sensor 118, 120 and may be connected to a control unit (not illustrated) configured to control operation of SCR system 110 and/or internal combustion engine 102.

Figure 3:
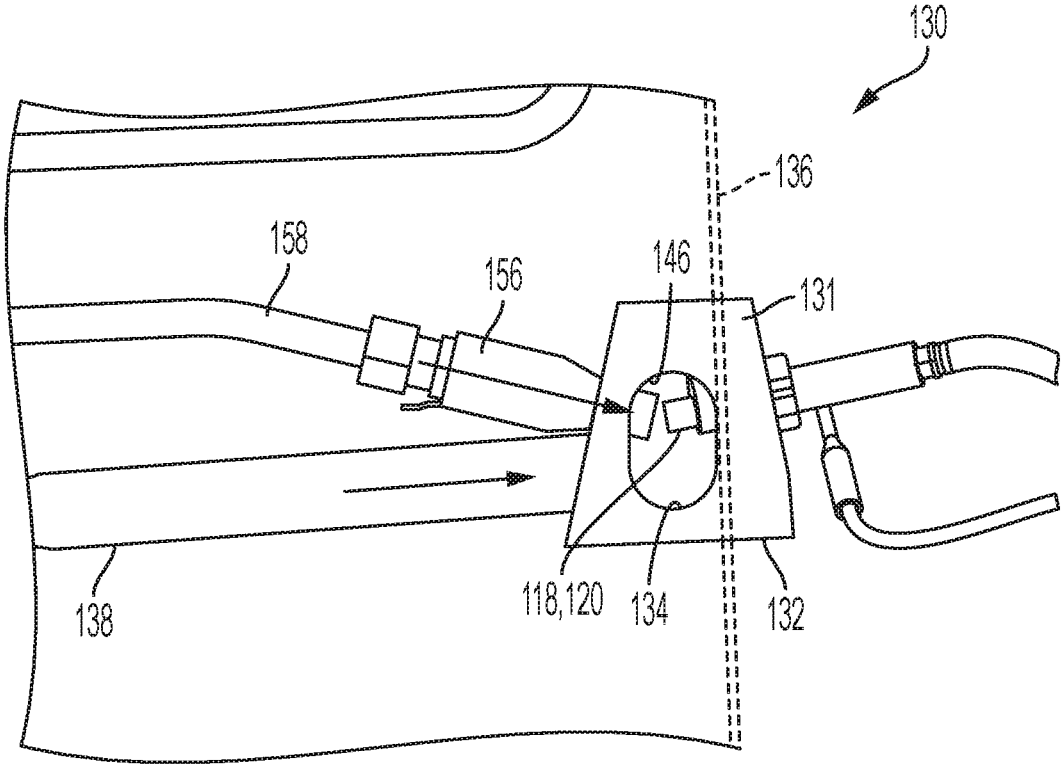
FIG. 3 shows a fragmentary, enlarged side elevational view of the NOx sensor protection system of FIG. 2.
Figure 4:
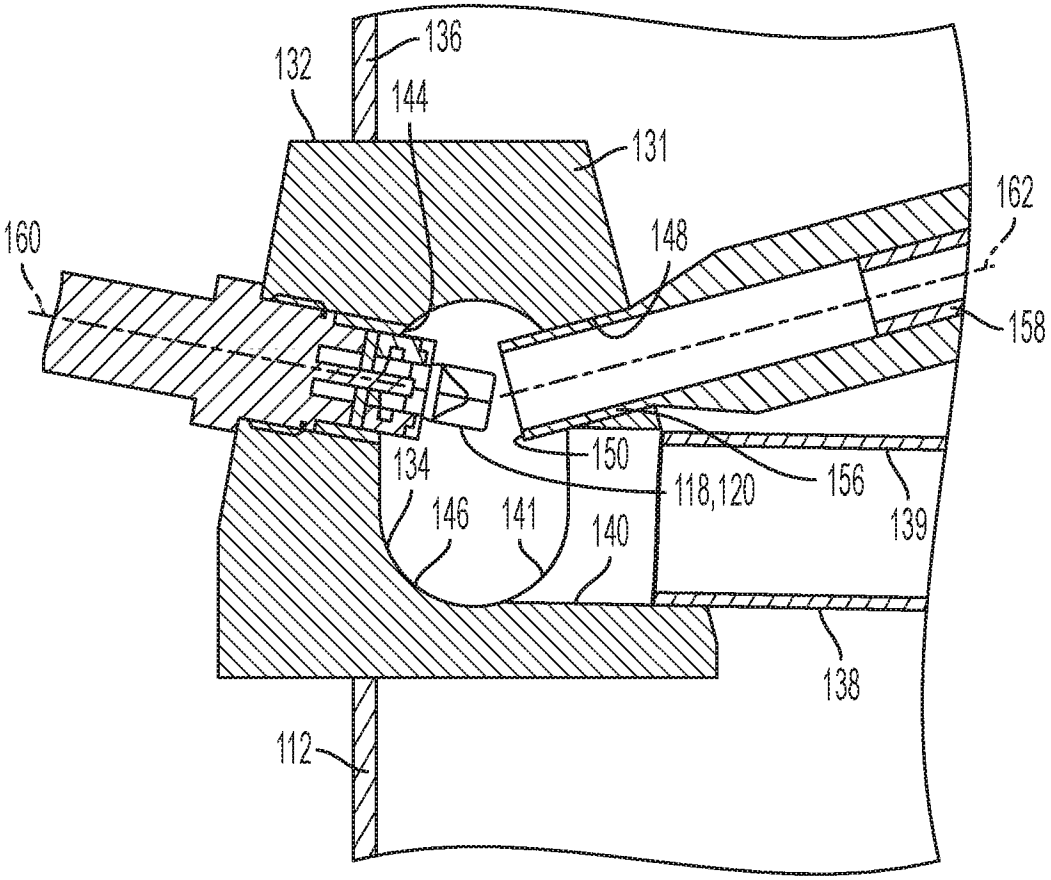
FIG. 4 shows a cross-section of the NOx sensor protection system of FIG. 4.
Figure 6:
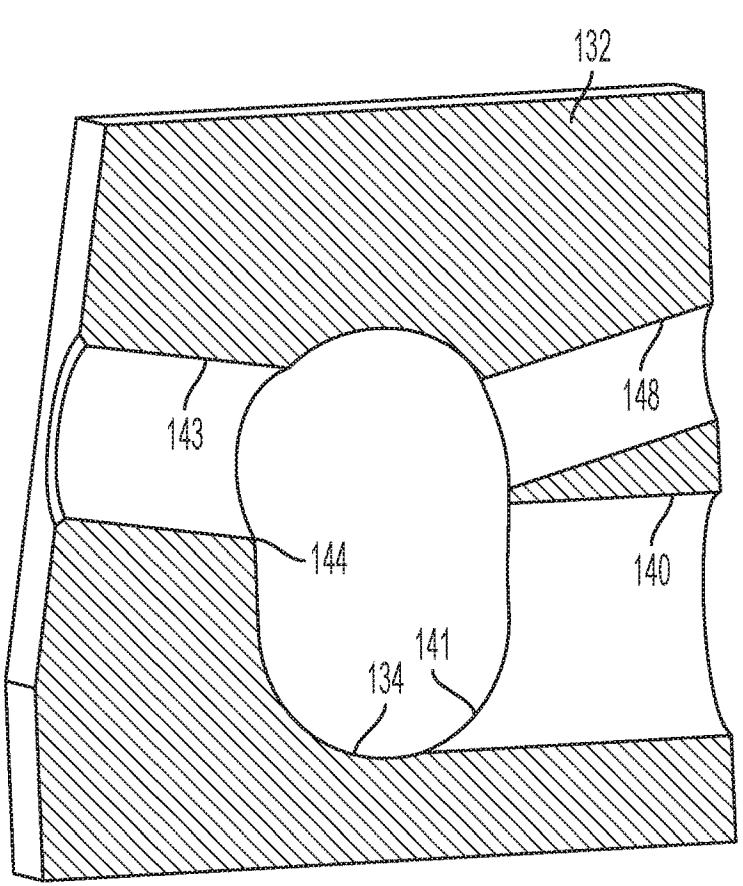
FIG. 6 is a cross-sectional view of the manifold of FIG. 5.
Figure 5:
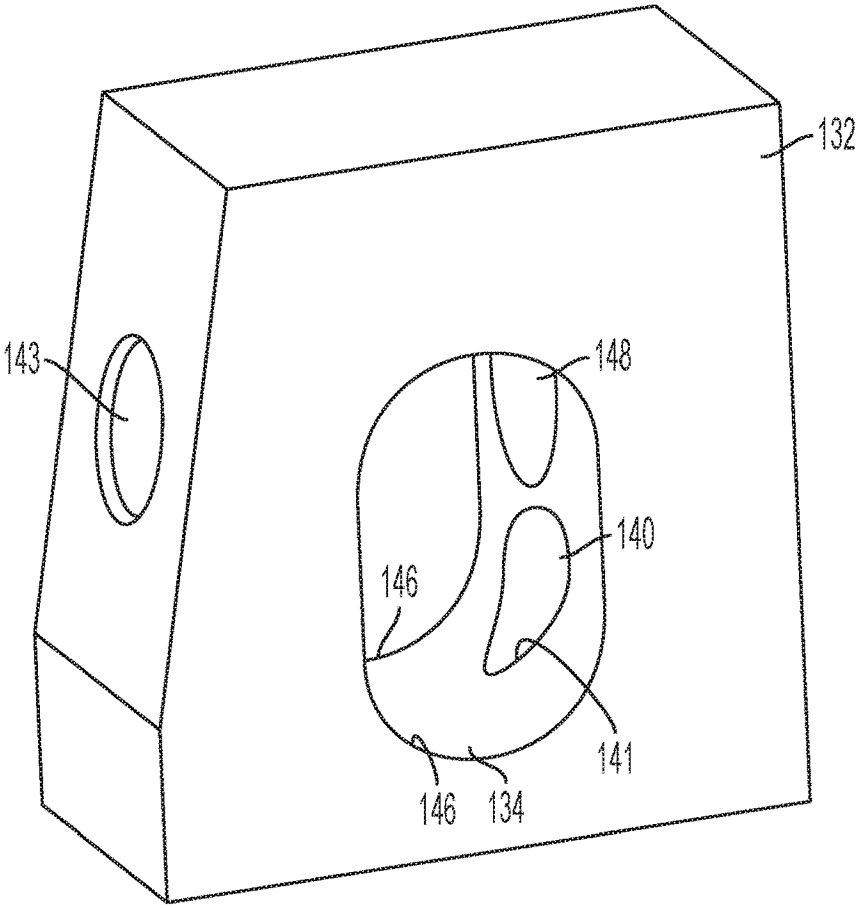
FIG. 5 is an isometric view of an exemplary manifold of the NOx sensor protection system of FIGS. 2-4.

Turning to FIG. 3, there is illustrated an exemplary embodiment of a NOx sensor protection system 130 according to teaching of this disclosure. The NOx sensor protection system 130 includes a flow control device 131 configured to allow a flow of exhaust from the exhaust pipe 112 to the NOx sensor 118, 120 when the internal combustion engine 102 is operated. In the illustrated embodiment the flow control device 131 includes a manifold 132 that having an internal chamber 134 (see also FIGS. 4-6). Both the NOx sensor 118, 120 and exhaust flowing through the exhaust pipe 112 are exposed to the internal chamber 134. In this way, the NOx sensor 118, 120 is exposed to exhaust gas flowing through the associated section of exhaust pipe 112 such that the NOx sensor 118, 120 may provide information to the SCR system 110 regarding the concentration of NOx in the exhaust gas.

In this embodiment, the manifold 132 extends through a wall 136 of the exhaust pipe 112 into the interior of the exhaust pipe 112. It will be appreciated, however, that the manifold 132 may be contained entirely within or outside of the exhaust pipe 112. When extending through the wall 136 of the exhaust pipe 112, however, the entire manifold 132 may be accessed for replacement or other service by sliding the manifold 132 outward from the wall 136.

Figure 2:
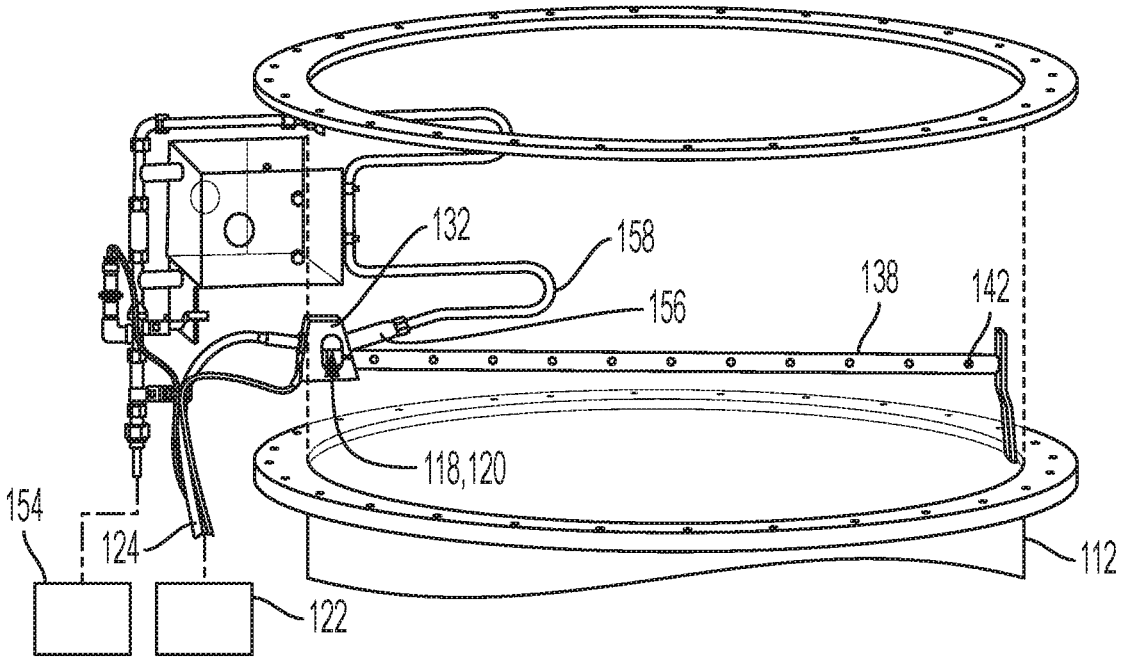
FIG. 2 shows an exemplary view of an exhaust treatment arrangement and NOx sensor protection system in an exhaust system of an internal combustion engine in accordance with aspects of the present disclosure.

The supply of exhaust gas may be provided to the internal chamber 134 of the manifold 132 by any appropriate arrangement. In the illustrated exemplary embodiment, a collection duct 138 extends across the section of exhaust pipe 112 associated with the SCR system 110. As shown in FIG. 2, the collection duct 138 may be mounted in exhaust pipe 112 in such a manner that it extends substantially perpendicular to the flow of exhaust in exhaust pipe 112, a hollow interior 139 of the collection duct 138 being fluidly coupled to the internal chamber 134 of the manifold 132 at an exhaust bore 140 forming an exhaust port 141 of the manifold 132. Those of skill in the art will appreciate that the collection duct 138 may extend partially into or through the exhaust bore 140 to couple the collection duct 138 to the manifold 132, or may be otherwise secured with the manifold 132. In some embodiments, the length of collection duct 138 may be substantially the same as the diameter of exhaust pipe 112. The collection duct 138 may be a "flute," or an elongated hollow tube-like structure that includes a plurality of inlet openings 142 distributed over the length of collection duct 138, fluidly communicating with the hollow interior 139 of the collection duct 138. In at least one embodiment, the inlet openings 142 open from the collection duct 138 in a direction generally perpendicular to the flow of exhaust gas within the exhaust pipe 112. Further, the inlet openings 142 may be arranged to face towards the end of the collection duct 138 disposed within the exhaust port 141 such that exhaust flowing in exhaust pipe 112 can enter collection duct 138 to flow through the exhaust port 141 and into the internal chamber 134 of the manifold 132.

In order to sense the concentration of NOx within the exhaust gas provided to the internal chamber 134 of the manifold 132, the NOx sensor 118, 120 is disposed within the internal chamber 134 of the manifold 132. In at least one embodiment, the NOx sensor 118, 120 is mounted through a NOx sensor bore 144 in the manifold 132. As illustrated, for example, in FIG. 4, the NOx sensor 118, 120 may project into the internal chamber 134 of the manifold 132 generally opposite the exhaust port 141 within the manifold 132. In at least one embodiment, the NOx sensor 118, 120 is disposed generally opposite the exhaust port 141.

In order to allow the exhaust entering the internal chamber 134 of the manifold 132 to exit the internal chamber 134 and to ensure current sensor readings, the manifold 132 may include one or more exit openings 146, preferably disposed at a position(s) that causes the exhaust to flow along the NOx sensor 118 within the internal chamber 134 of the manifold 132. In at least one embodiment the manifold 132 includes exit openings 146 disposed along either side of the manifold 132. In order to promote the flow of exhaust through the internal chamber 134 to the exit openings 146, the exit openings 146 have a larger cross-section than a cross-section of the exhaust port 141 by which exhaust enters the internal chamber 134.

According to an aspect of this disclosure, when the engine 102 is operating on HFO fuel, a shield gas may be provided to the internal chamber 134 of the manifold 132 in order to provide air flow to purge the NOx sensor 118, 120 from high sulfur exhaust resulting from operation of the engine 102 on HFO fuel. While the shield gas may be any appropriate gas, in at least one embodiment, the shield gas is compressed air. To this end, the manifold 132 may be provided with a shield gas bore 148 through which shield gas maybe provided to the internal chamber 134 through a shield gas port 150. Shield gas may be provided to the shield gas port 150 by way of a gas supply line 152, which is fluidly coupled to an external source of shield gas 154, such as a compressor. The compressor may be compressor 109 associated with the air intake system 104 or a separate compressor unit associated, for example, with a dosing cabinet (not shown). The shield gas port 150 may be formed by the shield gas bore 148 itself or a nozzle 156 extending through the shield gas bore 148. Such a nozzle 156 may be fluidly coupled to the external source of shield gas 154.

In order to minimize or eliminate rapid temperature changes to the manifold 132 or the sensor 118, the shield gas provided through the shield gas port 150 may be adjusted to more closely conform to the temperature of the exhaust flowing through the exhaust port 141 to the internal chamber 134 of the manifold 132, and/or the environment in which the manifold 132 is disposed, that is, within the exhaust pipe 112. In at least one embodiment, the gas supply line 152 includes an elongated tube 158 disposed within the exhaust pipe 112 (see FIG. 2). In this way, shield gas flowing through the elongated tube 158 may be heated by exhaust flowing through the exhaust pipe 112.

According to an aspect of this disclosure, the shield gas port 150 is disposed to provide an effective flow of shield gas to inhibit the flow of exhaust to the NOx sensor 118, 120. In at least one embodiment the shield gas port 150 is disposed to provide a flow of shield gas to the NOx sensor 118, 120 at an angle on the order of 135° to 180°, that is an angle formed between a centerline 160 of the NOx sensor 118, 120 and a centerline 162 of the shield gas port 150, shown in FIG. 4 as the centerline of the nozzle 156. In at least one embodiment the angle is approximately 150°.

In at least one embodiment, the shield gas port 150 is disposed proximal to the NOx sensor 118, 120 to provide a direct flow of shield gas to the NOx sensor 118, 120. As used herein, the term "direct flow" means a flow directly toward, as opposed to a flow which is deflected from another surface. In at least one embodiment, the shield gas port 150 is disposed within 2-5 mm of the NOx sensor 118, 120. In at least one embodiment the shield gas port is disposed within 2 mm of the NOx sensor.

According to another aspect of the disclosure, the manifold 132 may be cast or machined. For example, the manifold 132 may be formed of a solid block of material, such as an aluminum alloy. The one or more exit openings 146 and the exhaust bore 140, NOx sensor bore 144, and shield gas bore 148 may be machined into the block. Alternatively, the manifold 132 may be cast as a unitary structure.

INDUSTRIAL APPLICABILITY

Herein, the term "internal combustion engine" may refer to internal combustion engines which may be used as main or auxiliary engines of stationary power providing systems such as power plants for production of heat and/or electricity as well as in ships/vessels such as cruise liners, cargo ships, container ships, and tankers. Fuels for internal combustion engines may include diesel oil, marine diesel oil, heavy fuel oil, alternative fuels or a mixture thereof, and natural gas.

Examples of internal combustion engines for the herein disclosed systems include medium speed internal combustion diesel engines, for example, engines of the series M20, M25, M32, M34DF, M43, M46DF manufactured by Caterpillar Motoren GmbH & Co. KG, Kiel, Germany, operated in a range of 500 to 1000 rpm.

Some embodiments of the NOx sensor protection system 130 may be utilized in the flow of exhaust gas, eliminating the need for an exhaust bypass pipe utilized in some prior art structures.

Some embodiments of the NOx sensor protection system 130 minimize the likelihood of thermal cracking of the NOx sensor 118, 120 by providing a heated flow of shield gas.

In some embodiments, the impact of manufacturing tolerances may be minimized by use of the manifold 132, which may allow for optimal placement of the NOx sensor 118, 120, shield gas port 150, and flow of exhaust from the exhaust port 141 to provide better flow past the NOx sensor 118, 120.

Some embodiments of the NOx sensor protection system 130 may provide an economical, efficient arrangement with a manifold 132 that may be machined in low volume applications.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A NOx sensor protection system for an internal combustion engine configured to be selectively operated with a first fuel and a second fuel, and including an exhaust pipe configured to receive exhaust resulting from combustion of the first fuel or the second fuel in the internal combustion engine, the NOx sensor protection system comprising:

a flow control device forming an internal chamber and a plurality of ports opening into the internal chamber, said plurality of ports including an exhaust port configured to fluidly communicate with the exhaust pipe to receive exhaust flowing in the exhaust pipe, and a shield gas port configured to selectively receive a shield gas from an external source of shield gas;

a NOx sensor disposed within the internal chamber to measure a NOx concentration in the exhaust received within the internal chamber;

the flow control device being configured to selectively allow a flow of exhaust from the exhaust pipe to the NOx sensor when the internal combustion engine is operated with the first fuel, and a flow of the shield gas into the internal chamber to inhibit the flow of exhaust from the exhaust pipe to the NOx sensor when the internal combustion engine is operated with the second fuel;

wherein the shield gas port and the NOx sensor are configured to direct the flow of shield gas from the shield gas port at an angle on the order of 135° to 180° to the NOx sensor.

2. The system according to claim 1 the external source of shield gas includes a compressor.

3. The system according to claim 1 wherein the shield gas port includes a nozzle extending into the internal chamber, the nozzle being disposed within 2-5 mm of the NOx sensor.

4. The system according to claim 1 further including an elongated tube configured to fluidly couple the shield gas port with the external source of shield gas, the elongated tube being disposed within the exhaust pipe such that the flow of the shield gas through the elongated tube is heated by the exhaust.

5. The system according to claim 1 wherein the flow control device is a manifold, the manifold including the exhaust port and the shield gas port, the manifold further including a NOx sensor bore, the NOx sensor being disposed through the NOx sensor bore.

6. The system according to claim 1 further including a collection duct disposed within the flow of exhaust flowing in the exhaust pipe, the collection duct fluidly coupling exhaust flowing in the exhaust pipe to the exhaust port.

7. The system according to claim 6 wherein the collection duct includes an elongated hollow interior and a plurality of inlet openings opening into the elongated hollow interior, the plurality of inlet openings being configured to receive exhaust flowing in the exhaust pipe.

8. A NOx sensor protection system for an internal combustion engine configured to be selectively operated with a first fuel and a second fuel, and including an exhaust pipe configured to receive exhaust resulting from combustion of the first fuel or the second fuel in the internal combustion engine, the NOx sensor protection system comprising:

a flow control device forming an internal chamber and a plurality of ports opening into the internal chamber, said plurality of ports including an exhaust port configured fluidly communicate with the exhaust pipe to receive exhaust flowing in the exhaust pipe and direct the exhaust into the internal chamber, and a shield gas port configured to be selectively fluidly coupled to an external source of a shield gas and direct the shield gas into the internal chamber;

a NOx sensor disposed within the internal chamber to measure a NOx concentration in the exhaust received within the internal chamber;

the flow control device being configured to selectively allow a flow of exhaust from the exhaust pipe to the NOx sensor when the internal combustion engine is operated with the first fuel, and a flow of the shield gas into the internal chamber to inhibit the flow of exhaust from the exhaust pipe to the NOx sensor when the internal combustion engine is operated with the second fuel;

wherein the shield gas port and the NOx sensor are configured to provide a flow of the shield gas from the shield gas port directly at the NOx sensor, the shield gas port being disposed within 2-5 mm of the NOx sensor.

9. The system according to claim 8 wherein the shield gas port and the NOx sensor are configured to direct the flow of shield gas from the shield gas port at an angle on the order of 135° to 180° to the NOx sensor.

10. The system according to claim 8 the flow control device includes a nozzle extending into the internal chamber, the nozzle including the shield gas port, the nozzle being disposed to direct the flow of shield gas from the shield gas port at an angle on the order of 135° to 180° to the NOx sensor.

11. The system according to claim 8 wherein the external source of shield gas is a compressor.

12. The system according to claim 8 further including an elongated tube configured to fluidly couple the shield gas port with the external source of the flow of the shield gas, the elongated tube being disposed within the exhaust pipe such that the shield gas flowing through the elongated tube is heated by the exhaust.

13. The system according to claim 8 wherein the flow control device includes a manifold forming the internal chamber, the manifold including a plurality of bores, including a NOx sensor bore, the NOx sensor extending through the NOx sensor bore.

14. The system according to claim 13 wherein the plurality of bores includes an exhaust bore and a shield gas bore, the flow control device further including a nozzle extending through the shield gas bore into the internal chamber, the nozzle including the shield gas port, the system further including a collection duct disposed within the flow of exhaust flowing in the exhaust pipe, the collection duct extending through the exhaust bore and forming the exhaust port, the collection duct fluidly coupling exhaust flowing in the exhaust pipe to the exhaust port.

15. The system according to claim 8 further including a collection duct disposed within the flow of exhaust flowing in the exhaust pipe, the collection duct fluidly coupling exhaust flowing in the exhaust pipe to the exhaust port.

16. The system according to claim 15 wherein the collection duct is configured to be disposed across the exhaust pipe and includes an elongated hollow interior and a plurality of inlet openings opening into the elongated hollow interior, the plurality of inlet openings being configured to receive exhaust flowing in the exhaust pipe.

17. A NOx sensor protection system for an internal combustion engine configured to be selectively operated with a first fuel and a second fuel, and including an exhaust pipe configured to receive exhaust resulting from combustion of the first fuel or the second fuel in the internal combustion engine, the NOx sensor protection system comprising:

a NOx sensor;

a collection duct disposed within the flow of exhaust flowing in the exhaust pipe;

a nozzle configured to selectively receive a shield gas from an external source of shield gas;

a flow control device including a manifold including opposite sides and forming an internal chamber, the manifold having a plurality of bores opening into the internal chamber, the plurality of bores including a NOx sensor bore, an exhaust bore, and a shield gas bore, the manifold further including at least two exit openings, said two exit openings being disposed to open to opposite sides of the manifold, the collection duct being fluidly coupled to the exhaust bore to form an exhaust port to couple exhaust flowing in the exhaust pipe to the exhaust port to provide a flow of exhaust into and through the internal chamber to the at least two exit openings, the NOx sensor extending through the NOx sensor bore and being disposed within the internal chamber to measure a NOx concentration in exhaust received within the internal chamber, the nozzle extending through the shield gas bore and forming a shield gas port;

the flow control device being configured to selectively allow the flow of exhaust from the exhaust pipe to the NOx sensor when the internal combustion engine is operated with the first fuel, and a flow of the shield gas through the shield gas port into the internal chamber to inhibit the flow of exhaust from the exhaust pipe to the NOx sensor when the internal combustion engine is operated with the second fuel.

18. The system according to claim 17 wherein the at least two exit openings are disposed to provide a flow of exhaust air from the exhaust port through the internal chamber and out to the exhaust pipe, the at least two exit openings being larger than the exhaust port.

19. The system according to claim 17 wherein the shield gas port and the NOx sensor are configured to direct the flow of shield gas from the shield gas port at an angle on the order of 135° to 180° to the NOx sensor.

20. The system according to claim 17 wherein the manifold is machined.

* * * * *